United States Patent [19]

Smith et al.

[11] 4,196,841

[45] Apr. 8, 1980

[54] LAMINATE AND CONTAINER THEREFROM

[75] Inventors: Ernest L. Smith; Clifford G. Morse, both of Kansas City, Mo.

[73] Assignee: Phillips Petroleum Company, Bartlesville, Okla.

[21] Appl. No.: 894,284

[22] Filed: Apr. 7, 1978

[51] Int. Cl.[2] ..... B65D 5/64; B65D 43/02

[52] U.S. Cl. ..... 229/43; 156/69; 206/604; 206/631; 220/450; 220/457; 229/4.5; 229/5.5

[58] Field of Search ..... 206/631, 604, 634; 229/43, 4.5, 5.5, 62; 156/69; 428/213; 220/450, 457, 458, 359

[56] References Cited

U.S. PATENT DOCUMENTS

| | | | |
|---|---|---|---|
| 2,982,457 | 5/1961 | D'Alelio | 229/4.5 |
| 3,183,802 | 5/1965 | Rutledge | 229/4.5 |
| 3,335,939 | 8/1967 | Robinson, Jr. | 229/43 |
| 3,351,259 | 11/1967 | Lee, Jr. | 229/5.5 |
| 3,357,626 | 12/1967 | Carpenter et al. | 220/457 |
| 3,406,891 | 10/1968 | Buchner et al. | 229/5.5 |
| 3,580,483 | 5/1971 | Young | 206/631 X |
| 3,595,468 | 7/1971 | Repko | 229/62 X |
| 3,650,386 | 3/1972 | Tigner | 206/634 |
| 3,892,351 | 7/1975 | Johnson et al. | 229/43 |
| 3,944,126 | 3/1976 | Richards | 229/4.5 |
| 3,972,468 | 8/1976 | Reid | 229/4.5 |

*Primary Examiner*—Stephen P. Garbe

[57] ABSTRACT

A laminate comprising a substrate of paperboard having first and second surfaces; a layer of frangible paper having first and second surfaces, wherein the first surface of the frangible paper is bonded to the second surface of the paperboard; and a layer of frangible metal foil having first and second surfaces, wherein the first surface of the frangible metal foil is bonded to the second surface of the frangible paper; and wherein the laminate is so constructed that when a strip of material which has been securely bonded to the metal foil side of the laminate is pulled away from the laminate substantially all of the underlying laminate bonded to the strip will be severed substantially in the frangible paper layer. Also disclosed are blanks of such laminates which are suitable for forming a container, containers formed from such laminates, and sealed containers formed from such laminates.

28 Claims, 4 Drawing Figures

LAMINATE AND CONTAINER THEREFROM

This invention relates to the art of container manufacture. In one aspect this invention relates to a laminate suitable for making novel containers. In another aspect this invention relates to blanks of such a laminate, which blanks are suitable for making a novel container. In still another aspect this invention relates to a container the sidewalls of which comprise said laminate. Also this invention relates to a container having a novel peelably sealed closure.

Numerous containers having peelably sealed closures are known in the art. Generally the peelable seal is provided by securing the closure to the container by a coating of adhesive or other suitable bonding agent which bond upon the application of a certain amount of force will give to allow the closure to be removed.

Generally, much experimentation is necessary in order to discover the bonding agents and conditions of application that will provide a bond which is sufficiently strong to prohibit the closure seal from being accidentally broken while still allowing the closure to be readily removed when access to the container contents is desired.

An object of the present invention is to provide a laminate which provides a novel means of obtaining a peelably sealed closure on a container.

Another object of the present invention is to provide a container the sidewall of which comprises said laminate.

Another object of the present invention is to provide a sealed container having a peelably sealed closure secured thereto in a novel manner.

Still another object of the present invention is to provide a blank constructed of said novel laminate, which blank is suitable for making the sidewall of a container.

Other objects and advantages of the present invention will become more apparent from the following description, and claims, and the drawings provided herewith.

In accordance with the present invention, there is provided a laminate comprising a substrate of paperboard having first and second surfaces; a layer of frangible paper having first and second surfaces, wherein said first surface of said frangible paper is bonded to said second surface of said paperboard; and a layer of frangible metal foil having first and second surfaces, wherein said first surface of said frangible metal foil is bonded to said second surface of said frangible paper. The laminate is further constructed so that when a strip of material which has been securely bonded to the metal foil side of the laminate is pulled away from the laminate substantially all of the underlying laminate bonded to said strip will be severed substantially in the frangible paper layer. The term "frangible" as used herein with reference to the paper and the metal foil is intended to note that the paper and the metal foil are such that they will permit the severing of the laminate in the manner described when as described a strip of material securely bonded to metal foil side of the laminate is pulled away from the laminate.

In accordance with another embodiment of the instant invention there is provided a container comprising a tubular sidewall and a rim surrounding an opening in the top end of said tubular sidewall. The tubular sidewall comprises a laminate of the type described in the preceding paragraph and the rim comprises an outwardly extending portion of the upper end of said tubular sidewall.

In accordance with still another embodiment of the instant invention, there is provided a sealed container comprising a container of the type described in the preceding paragraph and a closure bonded to the rim of that container in such a manner that when the closure is later removed substantially all of the laminate of said rim that underlies the bond to said closure will be severed substantially in the frangible paper layer and the severed portion of said laminate will be retained on the removed closure.

In accordance with still another embodiment of the instant invention, there is provided a blank suitable for the manufacture of a tubular container comprising a generally planar sheet of the laminate of this invention wherein said sheet has two side edges, a bottom edge, and a top edge so shaped that a tube is formed when a margin of one side edge is overlapped over a margin of the other side edge.

In accordance with still another embodiment of the present invention there is provided a container comprising a tubular sidewall and a rim, wherein the tubular sidewall is one formed from a blank as described in the preceding paragraph by overlapping a margin of one side edge thereof over a margin of the other side thereof, and wherein the rim comprises an outwardly extending portion of the upper end of said tubular sidewall.

In accordance with still another embodiment of the present invention there is provided a sealed container comprising a container of the type described in the preceding paragraph and a closure bonded to the rim of that container in such a manner that when the closure is later removed substantially all of the laminate of said rim that underlies the bond to said closure will be severed substantially in the frangible paper layer and the severed portion of said laminate will be retained on the removed closure.

In the novel laminate of the instant invention the paperboard substrate can be of any suitable thickness. Generally the paperboard that would be employed would be of the type most often used in making paper containers. Generally such paperboard comprises substantially planar sheets having an average thickness in the range of about 0.014 to about 0.028 inch. In a preferred embodiment the paperboard has a thin coating of thermoplastic covering both its first and second surfaces. Generally the thermoplastic coatings have an average thickness of about 0.001 inch. In the preferred embodiment the thermoplastic coating on the second side of said paperboard serves to bond the frangible paper to the paperboard. The thermoplastic coating on the first side of the paperboard serves other purposes which are presently served by similar coatings on prior art paperboard containers.

Those skilled in the art having the benefit of this disclosure can with mere routine experimentation readily develop laminates which will function as above described.

A preferred type of laminate which has been developed employs as the frangible paper a kraft paper having a weight of about 25 pounds per 3000 square feet. The frangible foil employed in the preferred laminate is aluminum foil having an average thickness of about 0.00035 inch. The kraft paper is bonded to the paperboard by a thin coating of thermoplastic. Preferably the thermoplastic is low-density polyethylene of the type generally used in coating paperboard that is used in making paper containers. Generally the thermoplastic coating the paperboard surface has an average thickness of about 0.001 inch. The frangible metal foil can be bonded to the frangible paper by any suitable means which provides a bond that has more strength than the inherent strength of the frangible paper. In a preferred embodiment the frangible paper and the frangible metal foil are bonded by a suitable hot melt adhesive.

As indicated above the laminate of this invention is used to form a container which can be sealed to provide a novel type of peelable closure seal. The laminate is used to form the tubular sidewall of such a container in such a manner that the metal foil portion of the laminate is closer to the interior of the tube than is the paperboard portion. The upper end of said tubular sidewall is caused to extend outwardly to provide a rim around the upper end of the container. The closure in turn is bonded to the rim to provide a continuous seal around the opening in the upper end of the container.

The closure can be constructed of any suitable material. Presently closures constructed of aluminum foil are preferred. At typical aluminum foil closure has an average thickness of about 0.003 inch. The closure, of course, must be constructed of material that is stronger than either the frangible paper or the frangible metal foil of the laminate.

The closure is bonded to the rim by any suitable means that will provide a bond that is stronger than either the frangible paper or the frangible metal foil.

The laminate of the present invention can be used to form tubular sidewalls for such containers by any of the generally known techniques. For example, the laminate can be used to make generally cylindrical or frustoconical spirally wound tubular sidewall using techniques known in the art. Alternatively, blanks of the laminate of the present invention, which have two side edges, a bottom edge, and a top edge can be used to form tubular sidewalls for containers by overlapping the margin of one side edge of such a blank over a margin of the opposite side edge in the manner known in the art.

Further understanding of the present invention will be provided by now referring to drawings, wherein.

Figure 2:
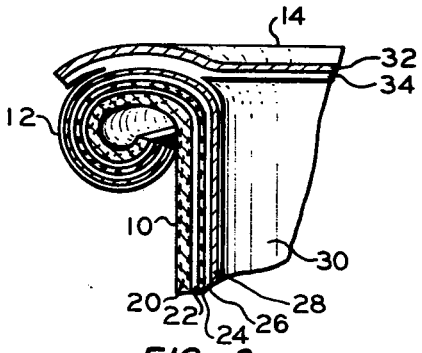
FIG. 2 is a vertical cross-sectional diagrammatical view taken along line 2—2 of FIG. 1.
Figure 3:
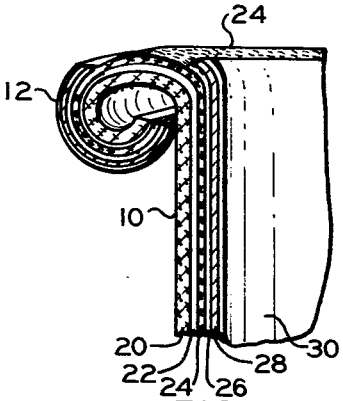
FIG. 3 is a vertical cross-sectional diagrammatical view taken along line 3—3 of FIG. 1.

In FIGS. 2 and 3 the layers of the laminate are not to scale but are illustrated only diagrammatically.

Figure 1:
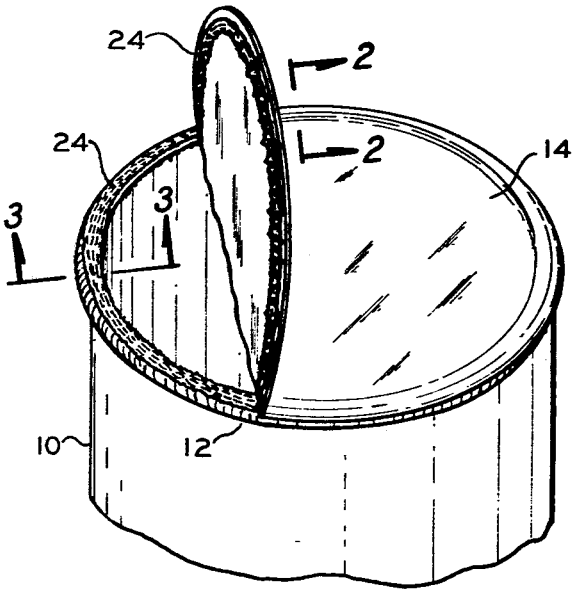
FIG. 1 is a top perspective view of a container constructed in accordance with the instant invention with a previously sealed closure having been partially removed.

FIG. 1 illustrates the upper portion of a generally cylindrical container having a sidewall 10 and a rim 12. Secured upon at least a portion of the sidewall is a closure 14. As illustrated in FIG. 1, a portion of the previously sealed closure 14 has been peeled away from the rim 12.

Figure 4:
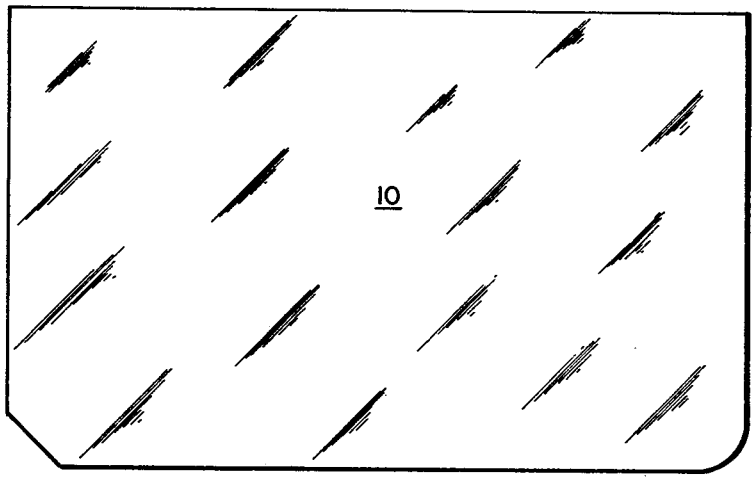
FIG. 4 illustrates a blank suitable for forming the tubular sidewall of a container of the type illustrated in FIG. 1.

The sidewall 10 of the container illustrated in FIG. 1 is constructed of a blank of a laminate of the instant invention. As shown in FIG. 4 the blank for constructing such a sidewall is generally rectangular, and has a top edge, a bottom edge, and two side edges. The tubular sidewall 10 would be formed by overlapping a margin of one side edge of the blank and a margin of the other side edge of the blank and then securing the two overlapped portions. In order to form a container of the instant invention the blank is folded so that the foil is closer to the interior of the container than is the paperboard.

The structure of the laminate is best seen in the cross-sectional views set forth in FIGS. 2 and 3. As there illustrated the laminate which makes up the tubular sidewall 10 comprises a paperboard substrate 20 having first and second surfaces. A layer of frangible paper 24 also having first and second surfaces has its first surface bonded to the second surface of the paperboard by a coating of thermoplastic 22.

In a preferred embodiment the first surface of the paperboard is also covered with a coating of thermoplastic, such as low-density polyethylene. As is known in the art such a coating provides a means for providing a good seal for the overlapping margins of the two side edges of the blank used in forming the container sidewall.

A layer of frangible metal foil 28 also having first and second surfaces has its first surface bonded to the second surface of the frangible paper 24 by a coating of a hot melt adhesive 26. The second surface of the frangible metal foil 28 is covered with a coating of thermoplastic 30.

The upper end of the tubular sidewall 10 is rolled outwardly to provide an outwardly extending rim 12 generally arcuate in cross-section.

FIG. 2 best illustrates how a closure 14 is bonded to the rim 12 of such a container. The closure 14 as illustrated comprises a layer of foil 32 having on its lower surface a coating of thermoplastic 34. The closure is sealed to the rim by an area 36 fusion between thermoplastic coating 30 of the rim 12 and thermoplastic coating 34 of the closure 14.

In a preferred embodiment the metal foil 32 of the closure is aluminum foil having an average thickness of about 0.003 inch and the thermoplastic layer 34 is low-density polyethylene having an average thickness of about 0.0015 inch and the thermoplastic layer 30 is low-density polyethylene havng an average thickness of about 0.001 inch.

FIG. 3 best illustrates what happens when the closure of a container so sealed is removed. When the closure 14 is pulled away from the rim 14 the laminate underlying the bond to the rim is severed substantially in the frangible paper 24. The severed portion of the laminate including portions of the frangible paper 24 is thus retained on the removed closure.

This novel arrangement provides a sealed container in which the closure is very securely attached but which can be readily removed when desired. It is noted that it is desirable to use with the inventive sealed container a thermoplastic overcap for use in resealing the container after the peelable closure has been removed. The preferred type of overcap is of the type having a depending skirt that snaps over the outermost portion of the outwardly extending rim.

From the foregoing description, one skilled in the art can readily practice the instant invention and without departing from the spirit and scope thereof, can make various changes and modifications of the invention to adapt it to various usages and conditions. It is to be noted that the instant invention is not intended to be limited to the specific examples illustrated in the FIGURES discussed above. The illustration and discussion thereof is only a specific embodiment of the present invention which has been provided to more clearly illustrate the features of the instantly claimed invention.

What is claimed is:

1. A laminate comprising a substrate of paperboard having first and second surfaces; a layer of frangible paper having first and second surfaces, wherein said first surface of said frangible paper is bonded to said second surface of said paperboard; and a layer of frangible metal foil having first and second surfaces, wherein said first surface of said frangible metal foil is bonded to said second surface of said frangible paper; and wherein the strength of the paperboard, the frangible paper, the frangible metal foil, and the bonds between said paperboard, said frangible paper, and said frangible metal bond are such that when a strip of material which has been securely bonded to the metal foil side of the laminate is pulled away from said laminate the laminate underlying the bond to said strip will be severed substantially in the frangible paper layer.

2. A laminate according to claim 1 wherein said paperboard has an average thickness in the range of about 0.014 to about 0.028 inch.

3. A laminate according to claim 2 wherein said frangible paper is kraft paper having a weight of about 25 pounds per 3000 square feet.

4. A laminate according to claim 3 wherein said frangible metal foil is aluminum foil having an average thickness of about 0.00035 inch.

5. A laminate according to claim 4 wherein said paperboard is bonded to said frangible paper by a heat-sealable thermoplastic coating.

6. A laminate according to claim 5 wherein said heat-sealable thermoplastic coating is low-density polyethylene having an average thickness of about 0.001 inch.

7. A laminate according to claim 6 wherein said kraft paper is bonded to said aluminum foil by a coating of hot melt adhesive.

8. A laminate according to claim 7 wherein said second surface of said aluminum foil is covered with a coating of low-density polyethylene having an average thickness of about 0.001 inch.

9. A container comprising a tubular sidewall and a rim surrounding an opening in the top end of said tubular sidewall, wherein said tubular sidewall comprises a laminate according to claim 8 with the metal foil of said laminate being closer to the interior of said tubular sidewall than is the paperboard of said laminate, and wherein said rim comprises an outwardly extending portion of the upper end of said tubular sidewall.

10. A sealed container comprising a container according to claim 9 and a closure bonded to said rim in such a manner as to provide a continuous seal around the opening in the top end of said container and in such a manner than when said closure is removed the laminate of said rim that underlies the bond to said closure will be severed substantially in the frangible paper layer and said severed portion of said laminate will be retained on the removed closure.

11. A sealed container according to claim 10 wherein said closure has on its lower surface a coating of low-density polyethylene having an average thickness of about 0.0015 inch and wherein said closure is bonded to said rim as a result of fusion between the polyethylene on said rim and the polyethylene on the lower surface of said closure.

12. A blank suitable for the manufacture of a tubular container comprising a generally planar sheet of the laminate of claim 8, wherein said sheet has two side edges, a bottom edge, and a top edge so shaped that a tube is formed when a margin of one side edge is overlapped over a margin of the other side edge.

13. A container comprising a tubular sidewall and a rim surrounding an opening in the top end of said tubular sidewall, wherein said tubular sidewall is a tube formed when a margin of one side edge of a blank as specified in claim 12 is overlapped over a margin of the other side edge of said blank with the metal foil of said laminate being closer to the interior of said tubular sidewall than is the paperboard of said laminate; and wherein said rim comprises an outwardly extending portion of the upper end of said tubular sidewall.

14. A sealed container comprising a container according to claim 13 and a closure bonded to said rim in such a manner as to provide a continuous seal around the opening in the top end of said container and in such a manner that when said closure is removed the laminate of said rim that underlies the bond to said closure will be severed substantially in the frangible paper layer and said severed portion of said laminate will be retained on the removed closure.

15. A sealed container according to claim 14 wherein said closure has on its lower surface a coating of low-density polyethylene having an average thickness of about 0.0015 inch and wherein said closure is bonded to said rim as a result of fusion between the polyethylene on said rim and the polyethylene on the lower surface of said closure.

16. A sealed container according to claim 14 wherein said closure comprises a generally planar sheet of aluminum foil having an average thickness of about 0.003 inch.

17. A sealed container according to claim 16 wherein said rim comprises an outwardly rolled portion of said sidewall which is generally arcuate in cross-section.

18. A container comprising a tubular sidewall and a rim surrounding an opening in the top end of said tubular sidewall, wherein said tubular sidewall comprises a laminate according to claim 1 with the metal foil of said laminate being closer to the interior of said tubular sidewall than is the paperboard of said laminate, and wherein said rim comprises an outwardly extending portion of the upper end of said tubular sidewall.

19. A sealed container comprising a container according to claim 18 and a closure bonded to said rim in such a manner as to provide a continuous seal around the opening in the top end of said container and in such a manner that when said closure is removed the laminate of said rim that underlies the bond to said closure will be severed substantially in the frangible paper layer and said severed portion of said laminate will be retained on the removed closure.

20. A blank suitable for the manufacture of a tubular container comprising a generally planar sheet of the laminate of claim 1, wherein said sheet has two side edges, a bottom edge, and a top edge so shaped that a tube is formed when a margin of one side edge is overlapped over a margin of the other side edge.

21. A container comprising a tubular sidewall and a rim surrounding an opening in the top end of said tubular sidewall, wherein said tubular sidewall is a tube formed when a margin of one side edge of a blank as specified in claim 20 is overlapped over a margin of the other side edge of said blank with the metal foil of said laminate being closer to the interior of said tubular sidewall than is the paperboard of said laminate; and wherein said rim comprises an outwardly extending portion of the upper end of said tubular sidewall.

22. A sealed container comprising a container according to claim 21 and a closure bonded to said rim in such a manner as to provide a continuous seal around the opening in the top end of said container and in such a manner that when said closure is removed the laminate of said rim that underlies the bond to said closure will be severed substantially in the frangible paper layer and said severed portion of said laminate will be retained on the removed closure.

23. A sealed container comprising (1) a tubular sidewall formed of a laminate comprising paperboard bonded to frangible paper which in turn is bonded to frangible metal foil wherein the frangible metal foil of said laminate is closer to the interior of said tubular sidewall than is said paperboard; (2) a rim comprising an outwardly extending portion of the upper end of said tubular sidewall, and (3) a closure bonded to said rim in such a manner as to provide a continuous seal around the opening in the top end of said container, wherein the strength of the paperboard, the frangible paper, the frangible metal foil, the closure, and the bonds therebetween are such that when said closure is separated from said rim the laminate that underlies the bond to said closure will be severed substantially in the frangible paper layer.

24. A sealed container according to claim 23 wherein said laminate includes a coating of thermoplastic on the surface of the frangible metal foil that is closest to the interior of said container, the closure has a coating of thermoplastic on its lower surface, and wherein the closure is bonded to said rim as a result of fusion between the thermoplastic on said frangible metal foil and the thermoplastic on the lower surface of the closure.

25. A sealed container according to claim 24 wherein said tubular sidewall is a tube formed when a margin of one side edge of a blank having two side edges, a bottom edge and a top edge is overlapped over a margin of the other side edge, and wherein said rim comprises an outwardly rolled portion of said sidewall which is generally arcuate in cross-section.

26. A sealed container according to claim 25 wherein said paperboard has an average thickness in the range of about 0.014 to about 0.028 inch, said frangible paper is kraft paper having a weight of about 25 pounds per 3,000 square feet, said frangible metal foil is aluminum foil having an average thickness of about 0.00035 inch, said paperboard is bonded to said frangible paper by a coating of low-density polyethylene having an average thickness of about 0.001 inch, wherein said kraft paper is bonded to said aluminum foil by a coating of hot melt adhesive, and wherein the coating of thermoplastic on the surface of the aluminum foil that is closest to the interior of the container is low-density polyethylene having an average thickness of about 0.001 inch.

27. A sealed container according to claim 26 wherein the coating of thermoplastic on the lower surface of the closure is a coating of low density polyethylene having an average thickness of about 0.0015 inch.

28. A sealed container according to claim 27 wherein said closure comprises a generally planar sheet of aluminum foil having an average thickness of about 0.003 inch.

* * * * *